US009695638B2

(12) United States Patent
Murray et al.

(10) Patent No.: US 9,695,638 B2
(45) Date of Patent: Jul. 4, 2017

(54) POSITIVE DISPLACEMENT MOTOR WITH RADIALLY CONSTRAINED ROTOR CATCH

(71) Applicant: Smith International, Inc., Houston, TX (US)

(72) Inventors: William Murray, Tomball, TX (US); Lance D. Underwood, Morrison, CO (US); Peter Thomas Cariveau, Spring, TX (US); Brian P. Jarvis, Bristol (GB); Nigel Wilcox, Bristol (GB); Brian Williams, Bristol (GB); Geoffrey Downton, Gloucestershire (GB); Lawrence Lee, Houston, TX (US); Shun'etsu Onodera, Katy, TX (US); Daniel Alvarado, Fort Worth, TX (US); Maxim Pushkarev, Katy, TX (US); Gokturk Tunc, Cambridge (GB); Andrei Plop, Dubai (AE)

( * ) Notice: Subject to any disclaimer, the term of this patent is extended or adjusted under 35 U.S.C. 154(b) by 0 days.

(21) Appl. No.: 14/358,944

(22) PCT Filed: Nov. 16, 2012

(86) PCT No.: PCT/US2012/065416

§ 371 (c)(1),
(2) Date: May 16, 2014

(87) PCT Pub. No.: WO2013/074865

PCT Pub. Date: May 23, 2013

(65) Prior Publication Data

US 2014/0332275 A1 Nov. 13, 2014

Related U.S. Application Data

(60) Provisional application No. 61/561,704, filed on Nov. 18, 2011, provisional application No. 61/651,313, filed on May 24, 2012.

(51) Int. Cl.
*E21B 4/02* (2006.01)
*F04C 2/107* (2006.01)
(Continued)

(52) U.S. Cl.
CPC ..... *E21B 4/02* (2013.01); *F03C 2/08* (2013.01); *F04C 2/1071* (2013.01); *F04C 13/008* (2013.01); *F04C 15/0065* (2013.01)

(58) Field of Classification Search
CPC ..... E21B 4/02; F04C 15/0065; F04C 2/1071; F04C 13/008
See application file for complete search history.

(56) References Cited

U.S. PATENT DOCUMENTS 1,378,442 A 5/1921 Chalfant
3,088,529 A * 5/1963 Cullen ..... E21B 4/02 175/107

(Continued)

FOREIGN PATENT DOCUMENTS

CN 101375019 A 2/2009
RU 2224079 C1 2/2004

(Continued)

OTHER PUBLICATIONS

International Search Report for International Application No. PCT/US2012/065416 dated Mar. 4, 2013.

(Continued)

*Primary Examiner* — Shane Bomar

(57) ABSTRACT

A moving cavity motor or pump, such as a mud motor, comprising: a rotor, a stator, and one or more apparatus for constraining (i.e., controlling or limiting) the movement of the rotor relative to the stator, where the apparatus for constraining is operable with the rotor catch.

26 Claims, 8 Drawing Sheets

(51) Int. Cl.

| | |
|---|---|
| ***F03C 2/08*** | (2006.01) |
| ***F04C 13/00*** | (2006.01) |
| ***F04C 15/00*** | (2006.01) |

(56) References Cited

U.S. PATENT DOCUMENTS

| | | | | |
|---|---|---|---|---|
| 3,894,818 | A * | 7/1975 | Tschirky | E21B 4/003 175/107 |
| 4,187,061 | A * | 2/1980 | Jurgens | E21B 4/02 175/107 |
| 4,397,619 | A | 8/1983 | Alliquander et al. | |
| 4,415,316 | A | 11/1983 | Jurgens | |
| 4,909,337 | A | 3/1990 | Kochnev et al. | |
| 4,923,376 | A | 5/1990 | Wright | |
| 5,096,004 | A | 3/1992 | Ide | |
| 5,171,138 | A | 12/1992 | Forrest | |
| 5,220,829 | A | 6/1993 | Manke et al. | |
| 5,395,221 | A | 3/1995 | Tucker et al. | |
| 5,679,894 | A | 10/1997 | Kruger et al. | |
| 6,309,195 | B1 | 10/2001 | Bottos et al. | |
| 8,627,901 | B1 * | 1/2014 | Underwood | E21B 7/14 175/107 |
| 8,967,299 | B2 * | 3/2015 | Bullin | E21B 4/006 175/107 |
| 9,334,691 | B2 | 5/2016 | Jarvis et al. | |
| 2002/0074167 | A1 | 6/2002 | Plop | |
| 2010/0092317 | A1 | 4/2010 | Suhara et al. | |
| 2010/0314172 | A1 | 12/2010 | Underwood et al. | |
| 2015/0167466 | A1 * | 6/2015 | Teodorescu | E21B 47/01 175/40 |
| 2015/0354280 | A1 * | 12/2015 | Downton | E21B 4/02 175/107 |

FOREIGN PATENT DOCUMENTS

| | | | |
|---|---|---|---|
| WO | 2006123927 | A1 | 11/2006 |
| WO | 2009127831 | A2 | 10/2009 |

OTHER PUBLICATIONS

First Office Action issued in related CN application No. 201280056577.3 dated Oct. 10, 2015, 9 pages.

Decision on Grant issued in corresponding Russian Application Serial. No. 2014124684, dated Jul. 6, 2016, 17 pages.

Search Report issued Mar. 22, 2011 in related UK application No. GB1019614.5 (4 pages).

International Preliminary Report on Patentability issued in corresponding International Application PCT/US2012/065416 on May 30, 2014. 8 pages.

* cited by examiner

POSITIVE DISPLACEMENT MOTOR WITH RADIALLY CONSTRAINED ROTOR CATCH

FIELD OF THE DISCLOSURE

Embodiments disclosed herein relate generally to downhole motors used in drilling the bore of a subterranean well. More particularly, embodiments disclosed herein relate to improving motor efficiency using one or more devices to provide corrective forces to the rotor or to constrain the position of a rotor relative to a stator in a mud motor.

BACKGROUND

Downhole motor assemblies, such as mud motors, are used to supplement drilling operations by turning fluid power into mechanical torque and applying this torque to a drill bit. The drilling fluid or drilling mud is used to cool and lubricate the drill bit, carry away drilling debris, and provide a mud cake on the walls of the annulus to prevent the hole from sloughing in upon itself or from caving in all together.

One example of a drilling assembly using a mud motor is illustrated in FIG. 1. The downhole assembly includes a motor 11 which is suspended on a string of tubing in the well. Motor 11 is of a progressive cavity type, and has a tubular housing 15 that contains an elastomeric stator 17. Stator 17 is a stationary elastomeric member having cavities 19 throughout its length. A rotor 21 extends through the cavities 19, and rotates as a fluid is passed through motor 11.

The downhole assembly has a longitudinal axis 35 that coincides with the longitudinal axis of motor 11. The lower end of rotor 21 will orbit eccentrically relative to axis 35, as indicated by the numeral 37. The amount of lateral deviation from the axis 35 may be on the order of about 3.1 mm to about 6.4 mm (about ⅛ to ¼ inch), for example. Rotor 21 is connected to a connector shaft 39 by a rotor coupling 41. Rotor coupling 41 forms a rigid connection which causes the upper end of connector shaft 39 to orbit in unison with the lower end of rotor 21. The lower end of connector shaft 39 connects to a drive shaft coupling 43, which is also a rigid coupling. Drive shaft coupling 43 rotates concentrically on the longitudinal axis 35. Connector shaft 39 will flex along its length because of the orbiting movement of its upper end. The drive shaft coupling 43 is then connected via a drive shaft 45, directly or indirectly, to the drill bit.

In operation, the motor assembly will be assembled and lowered into a well on a string of tubing. Once in place, drilling mud is supplied to motor 11, causing rotor 21 to rotate eccentrically. This causes connector shaft 39 to rotate, which in turn rotates drive shaft 45 and the drill bit (not shown). Motor 11 will discharge the fluid out the lower end and thence to the drill bit for cooling of the drill bit and removal of drill cuttings, where it flows to the surface.

Drilling motors or mud motors, such as illustrated in FIG. 1, may also include a rotor catch device that provides the operator the ability to retrieve a broken motor assembly in the unlikely event of a connector separation or mechanical failure. FIG. 2 illustrates a rotor catch device 30, where like numerals represent like parts. The rotor catch device extends from the top of rotor 21 into a top sub 32. Top sub 32 and stator 15 may include threaded sections 34 to connect the two components. Top sub 32 also includes a shoulder 36. The top end of rotor catch device 30 has an outer diameter greater than the inner diameter of shoulder 36. If any part of the external body (e.g., a stator connection) breaks below the top sub, the large end of the motor catch 30 will hang up on the shoulder 36, which in turn will allow the rotor and the rest of the motor to be pulled out of the hole.

SUMMARY OF THE CLAIMED EMBODIMENTS

In one aspect, embodiments disclosed herein relate to a mud motor assembly, comprising: a top sub comprising a shoulder having a first inner diameter proximate a distal end of the top sub; a power section comprising a progressive cavity motor comprising a stator and a rotor configured to rotate eccentrically when a drilling fluid is passed through the motor, the stator and rotor each having a proximal end and a distal end, wherein a proximal end of the power section is coupled to the distal end of the top sub; a rotor catch comprising a shaft having a proximal end and a distal end, and rotating eccentrically via transmission of the eccentric rotor motion; wherein the distal end of the shaft is coupled directly or indirectly to a proximal end of the rotor; wherein the shaft extends from the distal end of the rotor catch into the top sub a distance past the shoulder, wherein at least the portion of the shaft extending past the shoulder has an outer diameter less than the first inner diameter of the shoulder; wherein the proximal end of the shaft has an effective outer diameter greater than the first inner diameter and/or is coupled to a rotor catch assembly comprising one or more components having an effective outer diameter greater than the first inner diameter; at least one apparatus disposed intermediate the proximal and distal end of the rotor catch shaft, the at least one apparatus configured to constrain the radial and/or tangential movement of the rotor catch shaft and by transmission via the shaft to constrain the radial and/or tangential movement of the rotor.

In another aspect, embodiments disclosed herein relate to a drilling assembly, comprising: a mud motor assembly comprising a top sub and a power section; the top sub comprising a shoulder having a first inner diameter proximate a distal end of the top sub; the power section comprising a progressive cavity motor comprising a stator and a rotor configured to rotate eccentrically when a drilling fluid is passed through the motor, the stator and rotor each having a proximal end and a distal end, wherein the proximal end of the stator is coupled to the distal end of the top sub; a rotor catch comprising a shaft having a proximal end and a distal end, and rotating eccentrically via transmission of the eccentric rotor motion; wherein the distal end of the shaft is coupled directly or indirectly to a proximal end of the rotor; wherein the shaft extends from the distal end of the rotor catch into the top sub a distance past the shoulder, wherein at least the portion of the shaft extending past the shoulder has an outer diameter less than the first inner diameter of the shoulder; wherein the proximal end of the shaft has an effective outer diameter greater than the first inner diameter and/or is coupled to a rotor catch assembly comprising one or more components having an effective outer diameter greater than the first inner diameter; at least one apparatus disposed intermediate the proximal and distal end of the rotor catch shaft, the at least one apparatus configured to constrain the radial and/or tangential movement of the rotor catch shaft and by transmission via the shaft to constrain the radial and/or tangential movement of the rotor; a motor output shaft directly or indirectly coupled to the distal end of the rotor; and a drill bit directly or indirectly coupled to a distal end of the motor output shaft.

In another aspect, embodiments disclosed herein relate to a method of drilling a wellbore through a subterranean formation, the method comprising: passing a drilling fluid through a mud motor assembly or a drilling assembly according to embodiments disclosed herein, and drilling the formation using a drill bit directly or indirectly coupled to the rotor.

Other aspects and advantages will be apparent from the following description and the appended claims.

DETAILED DESCRIPTION

Figure 1:
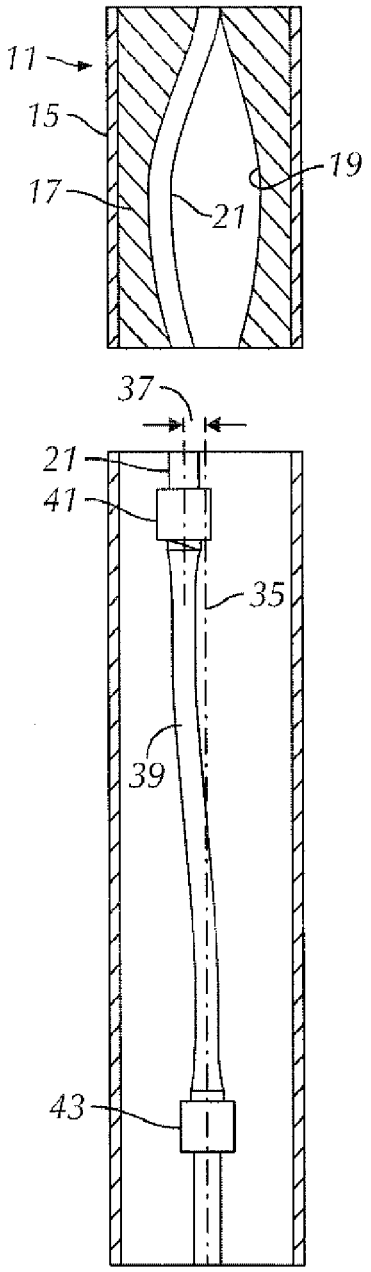
FIG. 1 (Prior Art)
FIG. 1 illustrates a prior art mud motor.
Figure 2:
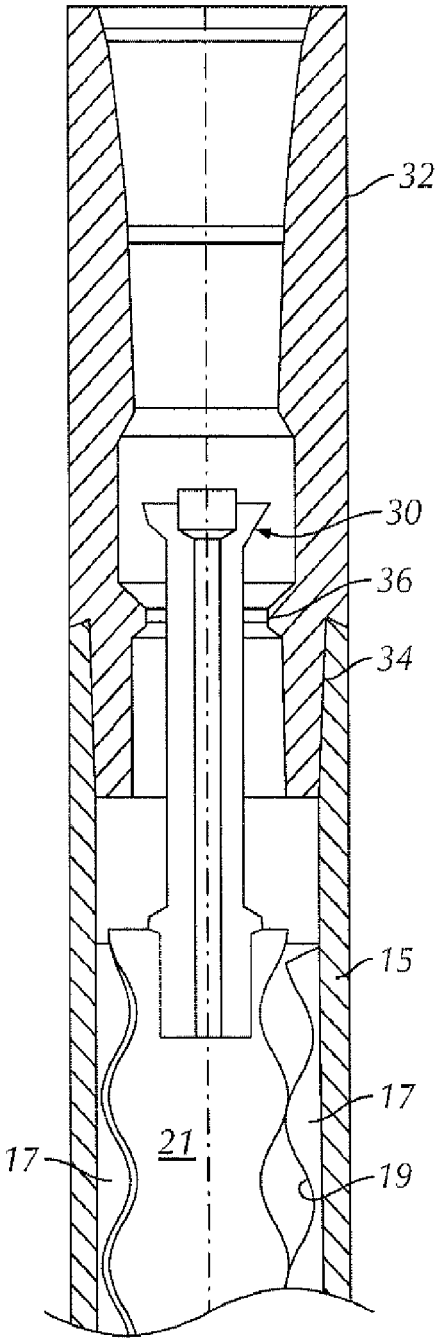
FIG. 2 (Prior Art)
FIG. 2 illustrates a motor catch used with mud motors.

It has been found that the forces imposed on the rotor during operation may result in flow gaps (loss of differential pressure driving force) along the length of the motor. These flow gaps resulting from improper sealing of the stator/rotor pair may reduce the rotary speed and limit the developed torque.

Forces imposed on the rotor during operation include those due to the pressure differential across the motor from inlet end to outlet end. The pressure differential may result in a pitching moment. There is also a downward force exerted on the drill string, commonly referred to as "thrust" or "weight on bit," where this force is necessarily transmitted through the rotor—drive shaft—drill bit couplings. The orbital—axial relationship of the drive shaft coupling may also result in angular and/or radial forces being applied to the rotor. Rotation of the rotor also results in tangential forces.

Each of these forces may have an impact on the manner in which the rotor interacts with the stator, such as the compressive forces generating seals along the edges of the resulting cavities, sliding, drag, or frictional forces between the rotor and the stator as the rotor rotates, etc. As a result, a flow gap may form along the length of the motor, reducing motor efficiency. Additionally, the impact of these forces may be different proximate inlet end and outlet end of the motor.

It has also been found that motor catch devices result in a significant amount of overhanging mass. This, in turn, may result in significant changes in the centrifugal forces at the top of the rotor as compared to design bases, further impacting the generation of flow gaps that reduce motor efficiency.

Embodiments disclosed herein relate to use of apparatus disposed on or operative with a rotor catch device for imparting corrective radial forces to the rotor. This radially inward force counteracts the centrifugal forces and hydraulic pressure loading on the rotor, constraining the movement of the rotor relative to the stator, thereby limiting, minimizing, or eliminating the formation of flow gaps along the length of the motor. Movement of a rotor relative to a stator is generally limited by the inherent resilience of the materials used to form the rotor and stator (e.g., deflection/compression of the rubber lining of the stator, etc.). As used herein, constraining the movement of the rotor relative to the stator refers to restricting or limiting the movement during use to a greater extent than would otherwise result or be permitted by the inherent resilience of the materials used to form the rotor and stator.

The improved sealing between the stator/rotor pair, resulting from the use of apparatus disposed on or operative with a rotor catch device for imparting corrective radial forces to the rotor, may thus result in an increase in one or more of rotary speed, developed torque, and pressure drop as compared to an unconstrained stator/rotor pair of similar size and configuration (i.e., lobe count, diameter, materials of construction, length, helix angle, etc.) For example, constraining the movement of the rotor relative to the stator according to some embodiments disclosed herein may result in the developed torque and/or rotary speed being increased by at least 5% over a motor of similar configuration without a constraining apparatus; developed torque and/or rotary speed may be increased by at least 10% in other embodiments; by at least 15% in other embodiments; by at least 20% in other embodiments; and by at least 25% in yet other embodiments. The resulting increase in torque and/or rotary speed may, for example, allow for a greater force to be applied to the drill bit or for the drill bit to be rotated at a greater rotary speed, both of which may individually or collectively result in improved drilling performance (less time to drill a given depth, etc.). Alternatively, the resulting increase in torque and/or rotary speed may allow for a reduction in the length of the motor (rotor/stator pair length) to achieve the same desired performance.

Figure 3:
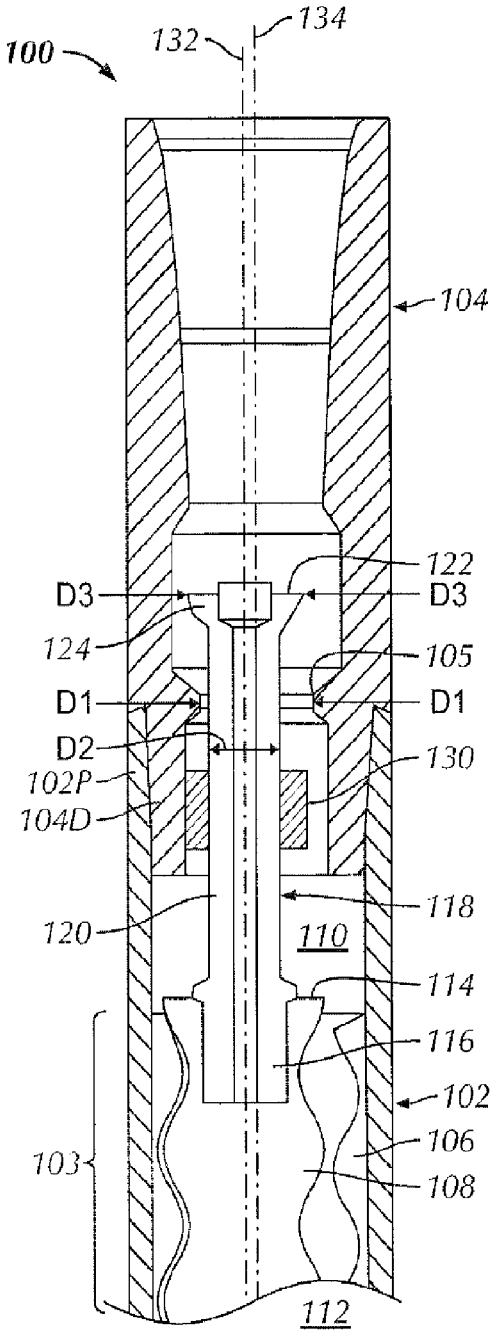
FIG. 3 is a simplified schematic diagram of a mud motor assembly according to embodiments disclosed herein.

Referring now to FIG. 3, a mud motor assembly according to embodiments herein is illustrated. The mud motor assembly 100 includes a power section 102 and a top sub 104, where the distal end 104D of top sub 104 is coupled to a proximal end 102P of power section 102. Top sub 104 includes a shoulder 105 having an inner diameter D1

Power section 102 includes a progressive cavity motor 103 having a stator 106 and a rotor 108. Rotor 108 is configured to rotate eccentrically when a drilling fluid is passed through the progressive cavity motor 103 from inlet 110 to outlet 112. A surface of the rotor 108, the stator 106, or both, is made of a flexible material to permit a seal to form between the contacting surfaces of the rotor 108 and stator 106.

The distal end of rotor 108 may be coupled, directly or indirectly, to a transmission or drive shaft (not shown), which in turn may be coupled to bearings, a bearing mandrel, a bit box, and ultimately to a drill bit for drilling through a subterranean formation.

Input (proximal) end 114 of rotor 108 is coupled to a distal end 116 of a rotor catch device 118. Although illustrated as coupled directly, rotor 108 may alternatively be indirectly coupled to rotor catch device 118. Rotor catch device 118, via coupling with rotor 108, also rotates eccentrically (i.e., in operation, rotor 108 transmits the eccentric rotor motion to the rotor catch device 118), and thus has a centerline 132 offset from the centerline 134 of the motor.

Rotor catch device 118 may include, for example, an elongated shaft 120 of constant or varying outer diameter between distal end 116 and proximal end 122 of rotor catch device 118. Shaft 120 extends from distal end 116 of rotor catch device 118 into top sub 104 a distance past shoulder 105. Although shoulder 205 is shown as being integral to top sub 204, it is understood that it may alternatively be constructed from one or more separate components and attached to top sub 204 by various means, including but not limited to threading. The section of shaft 120 extending through shoulder 105 has an outer diameter D2 less than the inner diameter D1 of shoulder 105. Proximal end 122 includes a portion 124 that has an effective outer diameter D3 greater than the inner diameter D1 of shoulder 105. In this manner, if any part of the external body of the motor assembly 100 or the drill string breaks or fails below top sub 104, the enlarged portion 124 will not be able to pass shoulder 105, allowing for rotor 108 and the rest of the motor 100 to be pulled out of the wellbore. Enlarged portion 124 may be integral with shaft 120, or may include one or more components (a rotor catch assembly) coupled to proximal end 122 of shaft 120.

Figure 4:
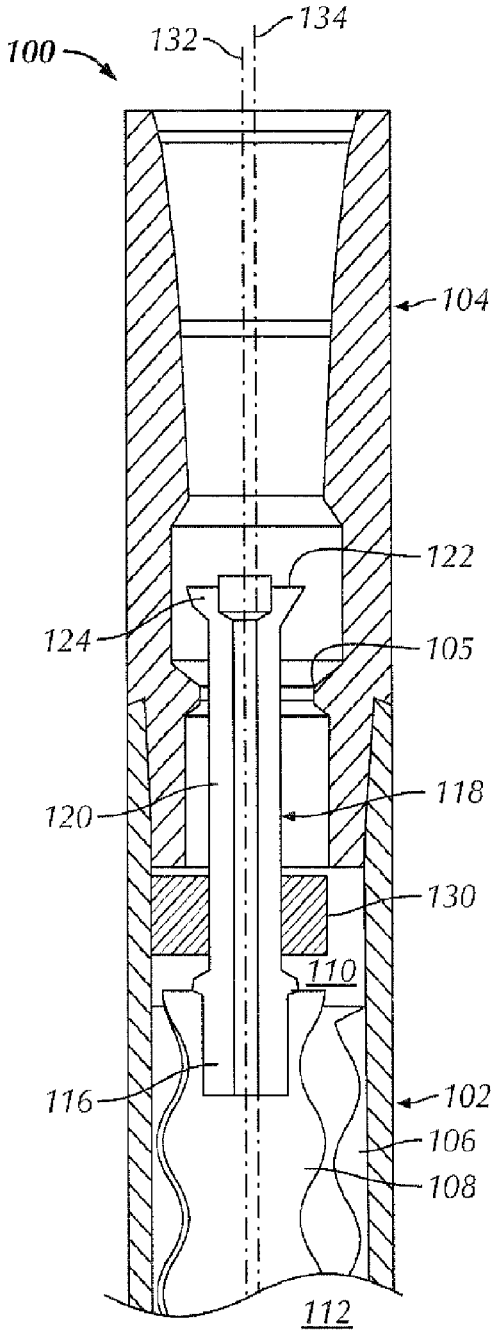
FIG. 4 is a simplified schematic diagram of a mud motor assembly according to embodiments disclosed herein.
Figure 5:
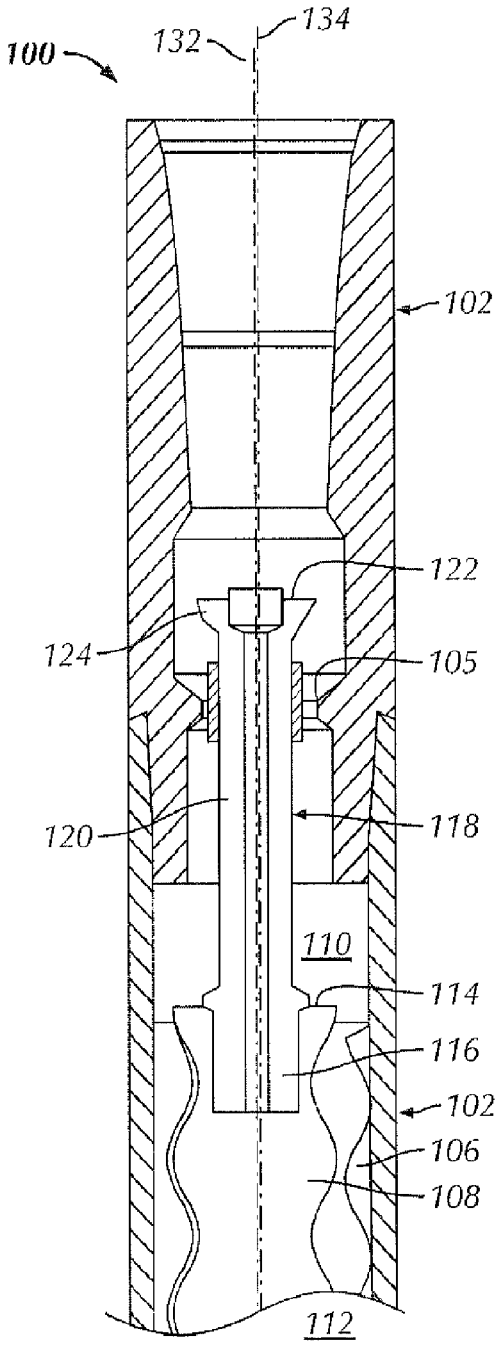
FIG. 5 is a simplified schematic diagram of a mud motor assembly according to embodiments disclosed herein.
Figure 6:
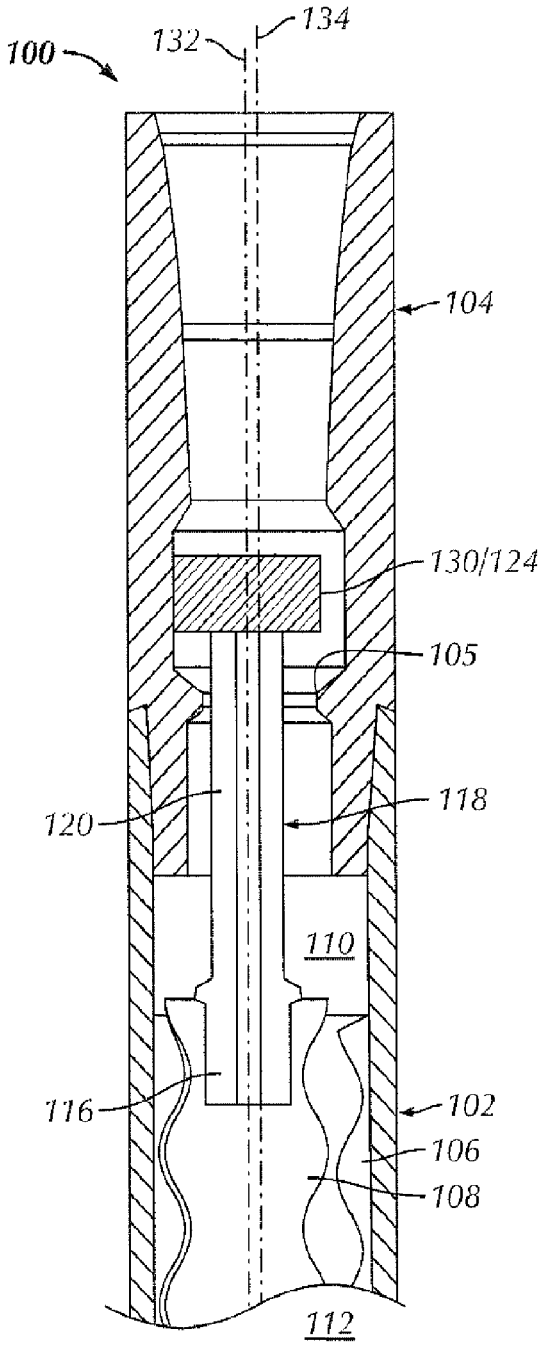
FIG. 6 is a simplified schematic diagram of a mud motor assembly according to embodiments disclosed herein.
Figure 13:
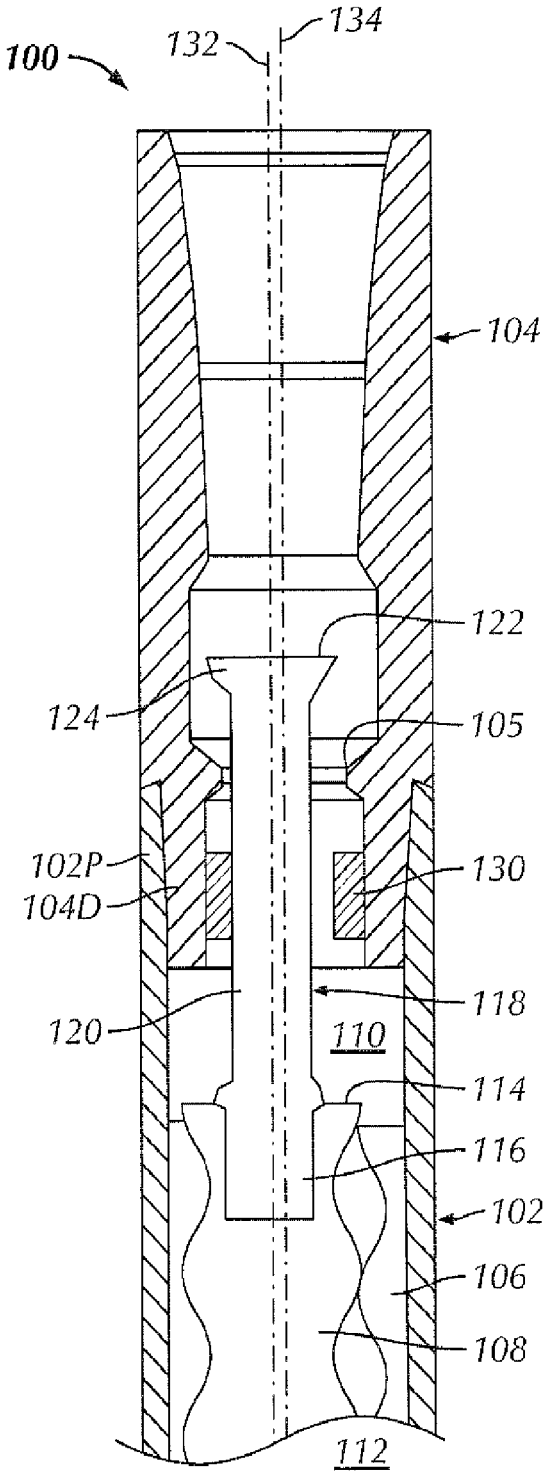
FIG. 13 is a simplified schematic diagram of a mud motor assembly according to embodiments disclosed herein.

Referring now to FIGS. 3-6, where like numerals represent like parts, mud motor assembly 100 also includes one or more apparatuses 130 for constraining the radial and/or tangential movement of shaft 120 of rotor catch device 118. Apparatus 130 may be located anywhere along the length of shaft 120. In some embodiments, apparatus 130 may be disposed intermediate shoulder 105 and distal end 116 or shaft 120, such as illustrated in FIGS. 3 and 4. In FIG. 3, apparatus 130 may be disposed on or operative with an inner surface of the top sub 104. In FIG. 4, apparatus 130 may be disposed on or operative with an inner surface of power section 102. In other embodiments, such as illustrated in FIG. 5, apparatus 130 may be disposed proximate shoulder 105. In yet other embodiments, apparatus 130 may be integral with or coupled to proximal end 122 of shaft 120. In such an embodiment, the rotor catch assembly may include apparatus 130 or apparatus 130 may additionally function as the rotor catch assembly. FIGS. 3-6 illustrate apparatus 130 as being disposed on rotor catch 118 (as an inner member, the inner surface of the top sub or power section being the outer member, similar to the constraining apparatus shown in FIG. 7 below). Apparatus 130 may also be disposed within the housing (as an outer member, the rotor catch or a portion thereof being the inner member, similar to the constraining apparatus shown in FIG. 8 below), as illustrated in FIG. 13, where like numerals represent like parts.

Due to coupling of the components, corrective forces imparted to rotor catch device 118 by constraining apparatus 130 may be transmitted via shaft 120 to rotor 108. In this manner, the forces constraining the radial and/or tangential movement of the rotor catch shaft may also constrain the radial and/or tangential movements of the rotor. As a result, the forces may counteract the centrifugal forces and hydraulic pressure loading on the rotor, limiting, minimizing, or eliminating the formation of flow gaps along the length of the rotor/stator pair.

Apparatus 130 may include a bearing assembly, a wheel assembly, a fixed insert, a rotatable insert, a precession device, or other means for controlling or limiting the movement of shaft 120 (and thereby controlling or limiting the movement of the rotor within the stator).

Figure 7:
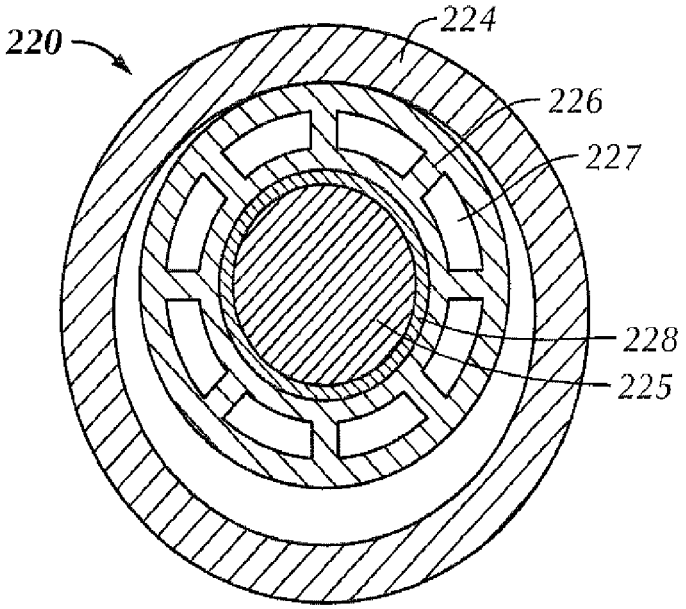
FIGS. 7-9 illustrate constraining apparatus for use in mud motor assemblies according to embodiments disclosed herein.

FIGS. 7-10 illustrate various embodiments of constraining apparatus 130. Referring now to FIG. 7, an apparatus 220 for controlling or limiting the movement of a rotor catch shaft 225 relative to an inner surface 224 of a top sub or a power section is illustrated. Apparatus 220 may be used at one or more locations on shaft 222. A bearing wheel 226 is supported on rotor catch shaft 222 through needle bearings 228, although other suitable bearings could also be used, such as roller bearings or journal bearings. In some embodiments, bearings 228 are journal bearings comprising silicon carbide, tungsten carbide, silicon nitride or other similarly wear resistant materials. The bearing wheel 226 may be manufactured with steel or other materials suitable for the intended environment. The outside surface of the bearing wheel 226 is designed to slide or roll around the inside surface of the 224 at a position where the profile is approximately circular. The difference in the radius of the bearing wheel 226 and the inside surface 224 of the top sub or power section defines the maximum offset of the rotor catch shaft axis from the motor axis. Bearing wheel 226 may include passages 227 incorporated to increase the area for fluid to flow through the device, where the passages may be of any number or shape, with the proviso that they be large enough to pass any solids that may be in the drilling fluid or drilling mud. Inside surface 224 has a circular profile where the bearing wheel 226 makes contact, such that the rotor catch shaft 222 centerline may be constrained to remain approximately within a circle of fixed radius, helping to prevent the opening of gaps between the rotor and stator surfaces.

Figure 10:
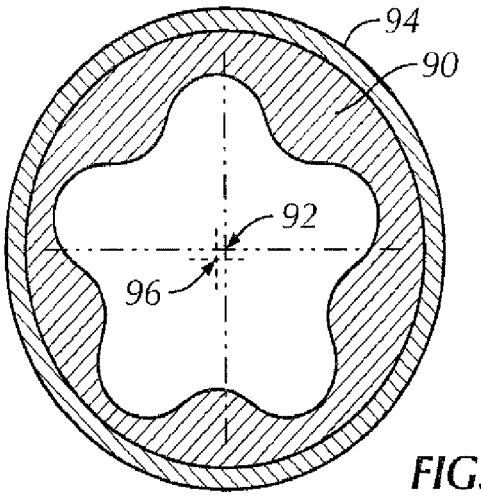
FIG. 10 illustrates a cross-sectional view of a non-concentric liner that may be used in mud motors according to embodiments disclosed herein.

In some embodiments, the bearing wheel 226 may slide or roll in direct contact with the interior surface 224 of top sub 104 or power section 102. In other embodiments, the bearing wheel 226 may slide or roll in contact with a coating placed on the interior surface of the stator cylinder. During manufacture of some stators, the interior surface of a cylinder, such as a pipe or tube, is machined or coated, such as by pouring, spraying, or injecting a coating material onto the interior surface of the cylinder. However, due to the complexity of the stator manufacturing process, concentricity of the resulting stator with the stator cylinder itself cannot be guaranteed. Thus, during manufacture, the resulting stator liner or coating 90 may be offset from the centerline 92 of the stator cylinder 94, such as illustrated in FIG. 10 where the resulting coating has a centerline 96 offset from the centerline 92 of the stator cylinder 94. As noted above, the outside surface of the bearing wheel 226 is designed to slide or roll around the inside surface 224 of the top sub or power section, where the profile is approximately circular. The bearing wheel 226 may thus also be configured to slide or roll around the inside surface of a coating material, such that the bearing wheel 226 slides or rolls along the same centerline as the rotor (i.e., aligned with stator lining and rotor, not with the power section housing cylinder or the top sub cylinder). Manufacture of a power section or a top sub for use with the bearing wheel 226 may thus also include coating, moulding or machining a section of constant diameter, such as 1.6 mm (1/16 inch) to 6.4 mm (1/4 inch) thick rubber, proximate the intended location of bearing wheel 226 during use, so as to ensure that the bearing wheel 226 properly constrains the path of the rotor and provide the desired benefit.

As noted above, the difference in the radius of the bearing wheel 226 and the inside surface 224 defines the maximum offset of the rotor axis from the stator axis. Additionally, for proper function, the bearing wheel 226 must maintain a sliding and/or rolling relationship with the inner surface of the stator so as to constrain the rotor through the entire rotation, i.e., maintaining contact over 360°. Due to the eccentric rotation of the rotor, the relative diameter of the bearing wheel 226 to that of the interior surface of 224 is an important variable, where an improper ratio may result in irregular contact of the bearing wheel with the inner surface 224, i.e., a non-rolling or non-sliding relationship.

In addition to diameter, the length of the bearing wheel 226 must also be sufficient to maintain the side loads imparted due to the wobble of the rotor and rotor catch shaft. Bearing wheel 226 should be of sufficient axial dimensions to address the structural considerations. The length of bearing wheel 226 may thus depend upon the number of lobes, motor/pump torque, and other variables readily recognizable to one skilled in the art, and may also be limited by the available space between the rotor and the drive shaft.

The bearing wheel 226, via transmission from the rotor catch shaft to the rotor, limits the extent of the wobble imparted by the eccentric motion of the rotor. This, in turn, may limit the formation of flow gaps along the length of the motor/pump by limiting the compression or deflection in the stator lining, such as a rubber or other elastic material. In some embodiments, the bearing wheel may limit the deflection of the stator lining by less than 0.64 mm (0.025 inches); by less than 0.5 mm (0.02 inches) in other embodiments; and by less than 0.38 mm (0.015 inches) in yet other embodiments.

Bearing wheel (26), as described above, radially constrains the position of the rotor, keeping the rotor in contact with the stator (i.e., providing an offset contact force without preventing the generation of torque). The resulting reduced normal force at the point of contact between the rotor and stator may reduce the drag forces, improving compression at the contact points, minimizing leakage paths. By limiting the formation of flow gaps (leakage paths) along the length of the rotor, pressure losses may be decreased, increasing the power output of the motor. Additionally, constraining the position of the rotor may reduce stator wear, especially proximate the top of the lobes, where tangential velocities are the highest.

Figure 8:
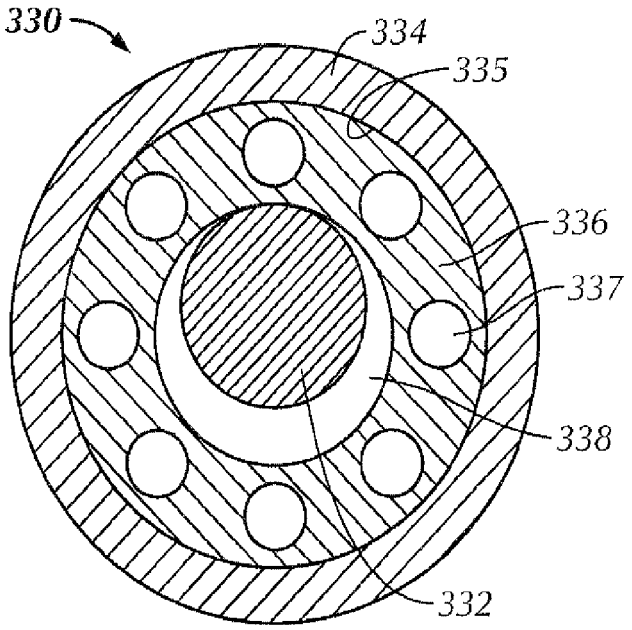

Referring now to FIG. 8, another embodiment of an apparatus 330 for controlling or limiting the movement of a rotor catch shaft 332 relative to an inner surface 335 of a power section or top sub body 334 is illustrated, in which a fixed insert 336 is fitted inside the power section or top sub. The fixed insert 336 has a central hole 338 or similar restriction of the inside diameter of the top sub or power section to limit the radial movement of the rotor catch shaft 332. The fixed insert 336 may also comprise a plurality of holes 337 to facilitate the passage of fluid along the mud motor assembly. The fixed insert 336 ensures that the rotor catch shaft 332 centerline will be constrained to remain approximately within a circle of fixed radius, helping to prevent the opening of gaps between the rotor and stator surfaces.

Figure 9:
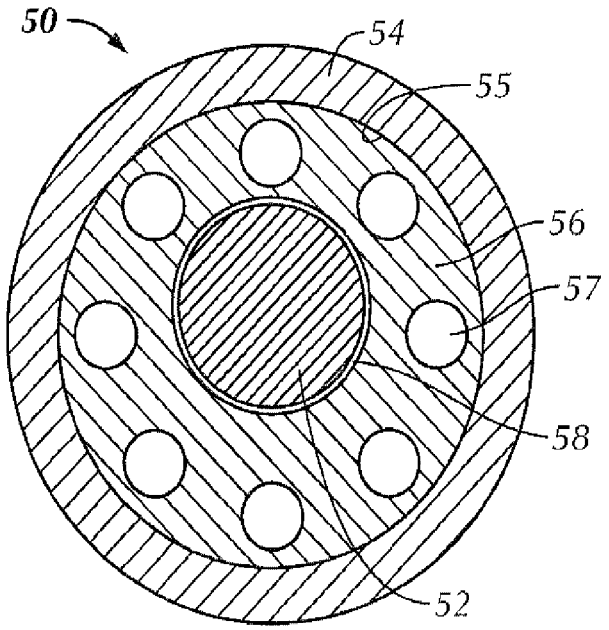

Referring now to FIG. 9, a further embodiment of an apparatus 50 for controlling or limiting the movement of a rotor catch shaft 52 relative to an inner surface 55 of a power section or top sub body 54 is illustrated. The apparatus 50 comprises a rotatable circular insert 56 which is fitted inside the body 54 and able to rotate about the longitudinal axis relative to the body 54. The rotation of the insert 56 relative to the body 54 is facilitated by a bearing between the body and the insert (not shown). An aperture 58 is provided in the insert 56, with the center of the aperture 58 offset from the center of the insert 56 by a distance equal to the maximum permissible offset of the rotor catch shaft axis from the axis of body 54. The diameter of the aperture 58 is of sufficient size to allow the rotor catch shaft 52 to pass through and rotate freely. A further bearing (not shown) is provided between the insert 56 and the rotor catch shaft 52 to facilitate the rotation of the rotor catch shaft 52 relative to the insert 56. The circular insert 56 includes holes 57 to allow the passage of fluid through the mud motor. The insert 56 ensures that the rotor catch shaft 52 centerline will be constrained to remain approximately within a circle of fixed radius, and via transmission constraining the rotor within a circle of fixed radius, helping to prevent the opening of gaps between the rotor (52) and stator (54) surfaces.

Similar design considerations regarding concentricity of operative areas as discussed above with respect to FIG. 7 may be used and similar deflection limits may also be attained using other embodiments of constraining apparatus disclosed herein, such as those of FIGS. 8 and 9. Similar to the embodiments of FIGS. 7 and 10, the fixed insert 336 as shown in FIG. 8 or the insert of FIG. 9 may be disposed within a molded power section or top sub profile such that the fixed insert 336 has the same centerline as the stator liner.

As described above, the embodiments illustrated in and described with respect to FIGS. 7-10 provide for limiting or constraining the extent of the radial movement of the rotor (i.e., limiting the orbital trajectory and path of the rotor during rotation). The embodiments disclosed herein may effectively limit outward radial movement, such as the restraint illustrated in FIG. 7, and may also limit the inward radial movement of the rotor, such as the restraint illustrated in FIG. 9.

Figure 11A:
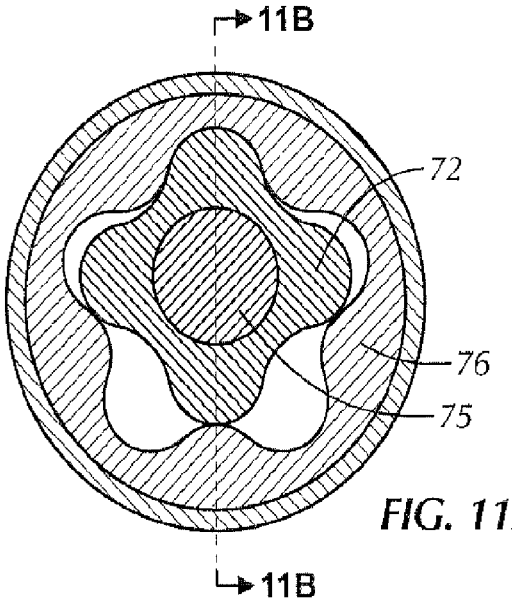
FIG. 11A shows a sectional view of a first embodiment of a mud motor assembly having a precessional apparatus for controlling the path and rotation of the rotor catch shaft according to embodiments disclosed herein.
Figure 11B:
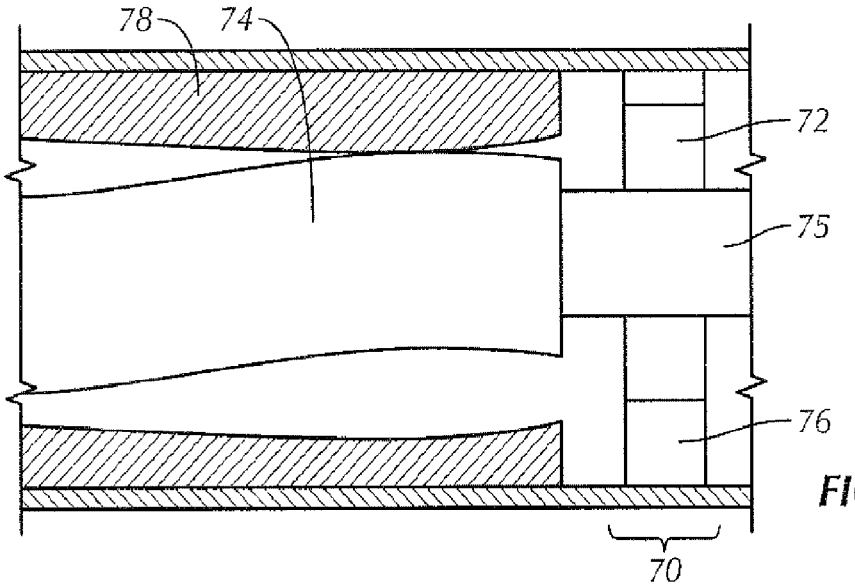
FIG. 11B shows a longitudinal sectional view through part of a mud motor assembly fitted with the apparatus of FIG. 11A.

In addition to the relatively circular means for constraining radial movement as illustrated in FIGS. 7-10, it is also possible to constrain movement of the rotor using a non-circular restraint, such as illustrated in FIGS. 11A (profile view) and 11B (longitudinal section view). In this embodiment, a precession apparatus 70 comprising a lobed wheel 72 of similar, but not identical profile to that of rotor 74 is operably connected to rotor catch shaft 75. Similarly, lobed wheel 72 would engage a track 76 of similar, but not identical, profile to that of stator 78. Track 76 may be formed of a material similar to that of stator 78, or may be a material that is less compressible than stator 78, such as a harder rubber, hard plastic, ceramic, PDC/diamond, or steel. A precession apparatus (70) may be used at one or more locations along rotor 74. In addition to addressing forces encountered at the inlet end or outlet end of the motor by location and/or materials of construction, the profile of track 76 may be similar to that of stator 78, and the respective sections 76, 78 may be out of phase to a degree, such that the orbital path of the rotor within stator 78 is constrained. In other words, the sections may be out of phase such that the forces of operation that distort the rotor from an ideal orbit are balanced and effectively constrain the orbital path of the rotor.

Precession apparatus 70 controls the rotor catch shaft 74 and via transmission the rotor 74 such that rotor 74 will move on a prescribed path and with a prescribed rotation relative to stator 78. This type of restraint may effectively lock the rotation of the rotor to its orbit position. The lobed wheel 72 engages with lobed track 76 such that the relative profiles of the lobed wheel 72 and track 76 fix the path and rotation of the rotor 74 to prescribed values.

The lobed wheel 72 is connected to the rotor catch shaft 75 in a substantially fixed way. The ratio of the number of lobes on the wheel 72 to the number of lobes on the track 76 is limited to the same ratio as the number of lobes on the rotor 74 to the number of lobes on the stator 78. The profiles of the lobes on the wheel 72 and on the track 76 will determine the extent to which the rotor 74 can deform the sealing surface of the stator 78 and therefore limits the opening of gaps between them.

To allow some rotational compliance, the surface of the lobed wheel 72 or the track 76 may have a flexible layer added of, for example, rubber. The lobed wheel 72 and track 76 could have parallel sides or incorporate a helix angle to allow for some small axial movement and accommodate manufacturing tolerances.

The profile and composition (material of construction, compressibility, etc.) of lobed wheel 72 may be designed such that the deformation of the rubber in stator 78 is limited. In other embodiments, the profile and composition of lobed wheel 72 may be designed such that the deformation of the rubber in stator 78 is maintained to a fixed value. In this manner, the interaction between the rotor 74 and the rubber in stator 78 is used to maintain sealing, with the torque being generated largely on lobed wheel 72. This not only allows pressure loading up to the point where the seal would fail (a very high pressure) but it also ensures that the contact forces in the rubber can be kept substantially independent of pressure magnitude. This should reduce wear and fatigue failure in the rubber as well as improve motor/pump efficiency.

As described above, various apparatus may be used to constrain the motion of the rotor catch device, and via transmission via the rotor catch shaft may constrain the motion of the rotor relative to the stator. Constraining apparatus according to embodiments disclosed herein may thus constrain the orbital path of the rotor relative to the stator, fix the orbital path of the rotor relative to the stator, and/or limit the movement of a geometric centre of the rotor to a predetermined path.

Figure 12:
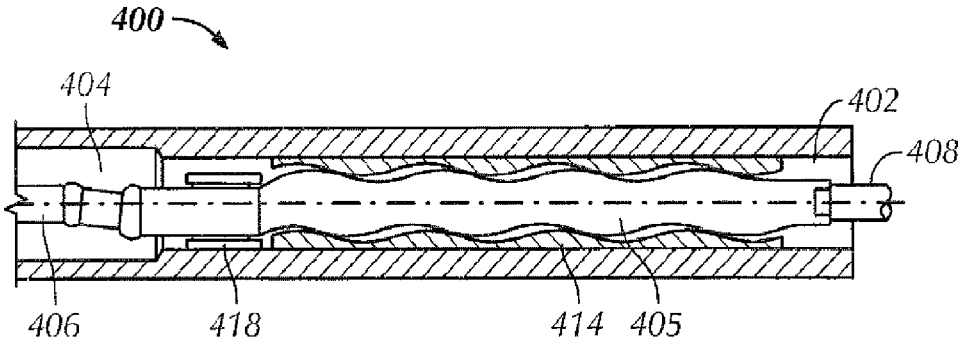
FIG. 12 illustrate a mud motor assembly/drilling assembly having apparatus for controlling the path and rotation of the rotor relative to the stator associated with both the distal end of the rotor and the rotor catch.

As noted above, the forces imposed on the rotor may be different proximate the inlet end (proximal end) of the power section than those proximate the outlet end (distal end) of the power section, resulting in different radii of orbits for the rotor center at the inlet and outlet ends. The constraining apparatus disposed on or operative with the rotor catch as described above may thus, in some embodiments, be sufficient for imparting the desired corrective forces on the proximal end of the rotor, but insufficient for imparting the desired corrective forces on the distal end of the rotor. In such instances, it may be desirable for mud motor assemblies to include constraining apparatus disposed on or operative with the distal end of the rotor, such as illustrated in FIG. 12. A mud motor 400, having a proximal end 402 and a distal end 404, includes a rotor 405 coupled to a drive shaft 406 and a rotor catch 408 constrained as described above (constraining apparatus not shown). Mud motor 400 also includes an apparatus 418 for constraining the motion of the distal end of rotor 405, where apparatus 418 may include one or more of the constraining apparatus as described above, and may be disposed on or operative with the distal portion of rotor 405. The constraining apparatus 418 and that used with the rotor catch may be the same or different, and may be designed in view of the forces expected to be encountered at the respective ends of rotor 405. Use of a constraining apparatus on both the rotor catch 408 and the distal end of the rotor 405 may thereby impart corrective forces to both ends of rotor 405, constraining the radial and/or tangential movement of rotor 405 relative to stator 414, decreasing, minimizing, or eliminating the flow gaps along the length of the motor/power section, thereby improving motor efficiency. Apparatuses disclosed herein, such as that illustrated in FIG. 12, among others, may also reduce stator wear.

The above described mud motor assemblies may be used in a drilling assembly for drilling a wellbore through a subterranean formation. The drilling assembly may include, for example, a mud motor assembly as described in any of the above embodiments, including among other components: a top sub, a power section including a progressive cavity motor having a stator and a rotor configured to rotate eccentrically when a drilling fluid is passed through the motor, a rotor catch device, and a device for constraining the motion of the rotor catch device. The drilling assembly may also include a motor output shaft configured to rotate concentrically, a first end of which is directly or indirectly coupled to a distal end of the rotor, and a second end of which is coupled, indirectly or directly, to a drill bit.

In operation, a drilling fluid is passed through the mud motor assembly, eccentrically rotating the rotor as the drilling fluid passes through the progressive cavity motor. The motor output shaft transmits the eccentric rotor motion (and torque) to the concentrically rotating drill bit to drill the formation. The device for constraining the motion of the rotor catch device imparts corrective forces to the rotor, constraining the movement of the rotor relative to the stator, improving the overall performance of the mud motor and the drilling assembly as a whole by counteracting the centrifugal forces and hydraulic pressure loading on the rotor, limiting, minimizing, or eliminating the formation of flow gaps along the length of the motor.

The improved sealing between the stator/rotor pair resulting from the use of constraining apparatus disclosed herein may thus result in an increase in one or more of rotary speed, developed torque, and pressure drop as compared to a stator/rotor pair of similar size and configuration (i.e., lobe count, diameter, materials of construction, length, helix angle, etc.) without such a constraining device The resulting increase in torque and/or rotary speed may, for example, allow for a greater force to be applied to the drill bit or for the drill bit to be rotated at a greater rotary speed, both of which may individually or collectively result in improved drilling performance (less time to drill a given depth, etc.). Alternatively, the resulting increase in torque and/or rotary speed may allow for a reduction in the length of the motor (rotor/stator pair length) to achieve the same desired performance.

Improvements in motor efficiency, such as sealing improvements and higher power output per length, as noted above, may be used, in some embodiments, to shorten the overall length of the motor while attaining a desired power output. A shortened power section may have numerous benefits and applications, as discussed below.

The limited overall axial length of the power section may allow for flow of solids, such a drilling mud including solid materials, through the motor without issue, even where both the rotor and stator have contact surfaces formed from rigid materials. The limited overall axial length may also provide flexibility in materials of construction that would otherwise be cost prohibitive.

In some embodiments, the rotor and/or the stator may be formed from a metal, composite, ceramic, PDC/diamond, hard plastic, or stiff rubber structural material. For example, both the rotor and stator may be formed from a metal, providing metal-to-metal contact along the length of the power section.

Figure 14:
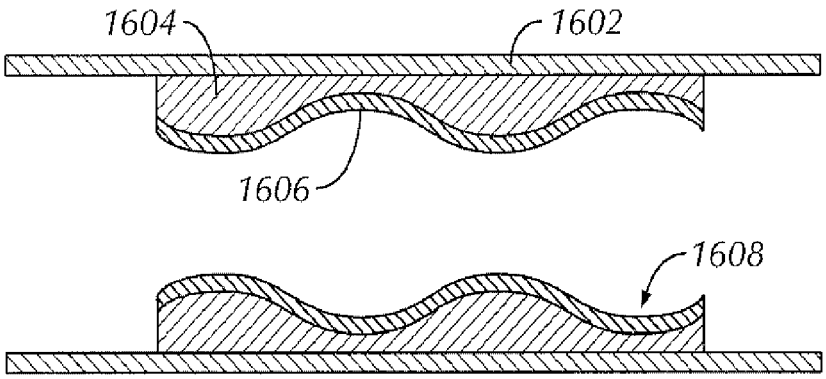
FIGS. 14-16 illustrate rotors and stators, useful in mud motors, according to embodiments disclosed herein.
Figure 15:
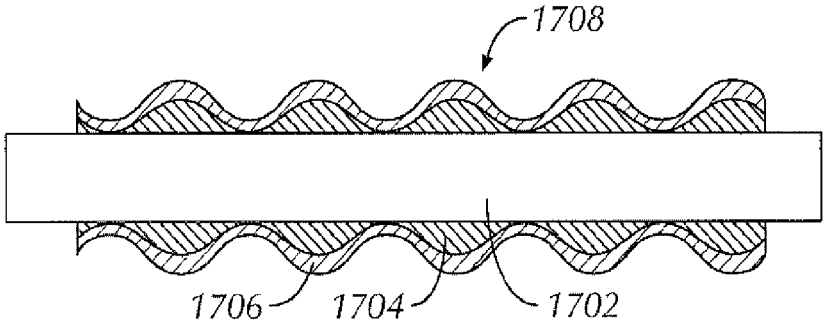

In other embodiments, the rotor and/or stator may be formed with a resilient layer (such as NBR rubber) and a hard layer, such as a hard rubber or plastic, ceramic, composite, or metal coating disposed as the contact surface on top of the resilient inner layer. For example, the rotor may be a metal, similar to currently produced rotors, and the stator may be a metal-coated rubber, where the metal layer is the layer contacting the rotor during operation of the motor. Similarly, a hard rubber or reinforced rubber layer may be provided as the innermost layer contacting the rotor. Typical "layered" stators disclosed in the prior art provide for a hard or reinforced inner elastomeric layer, opposite that of the present embodiments, to provide for the desired compression and sealing properties of the outer layer. However, due to the decreased axial length of the power sections, use of a rigid contact layer may be possible, improving wear properties of the motor (rotor, stator, or both) while providing the desired power output. While exemplified with a multi-layered stator, multi-layered rotors may also be used, such as a rotor having a metal core to provide torque capacity, an elastomeric material disposed on the core, and a metal shell. These embodiments are illustrated in FIGS. 14 and 15 for the rotor and stator, respectively, where the stator (FIG. 14) may include a metal housing 1602, an elastomer layer 1604, and a rigid layer 1606 providing contact surface 1608, and the rotor (FIG. 15) may include a metal core 1702, an elastomer layer 1704, and a rigid layer or shell 1706 providing contact surface 1708.

Where the corresponding contacting portions of the rotor and stator(s) are both rigid, such as a metal, hard plastic, composite, or ceramic, for example, it may be desirable to limit the friction, wear, and other undesirable interactions between the rotor and stator that may cause premature failure or seizure of the rotating component. The contact surfaces of the insert and/or the rotor may be coated or treated to reduce at least one of friction and wear. Treatments may include chroming, HVOF or HVAF coating, and diffusing during sintering, among others. Metal-to-metal (rigid-to-rigid) power sections may also provide sufficient clearance to be tolerant of debris, but tight enough to constrain the rotor motion close to ideal, achieving the above-noted benefits, without use of constraining devices.

Similarly, the relatively short contact length between the constraining devices and the rotor or stator may provide for flexibility in materials, and similar combinations of hard materials or hard-coated materials may be used for the constraining devices.

Alternatively, a resilient elastomer may be used as the contact surface on both the rotor and stator. The reduction in the otherwise high frictional loads attained by the constraining devices may provide for use of elastomeric stators and rotors in combination to attain a desired pump performance (power output, wear properties, etc.).

Figure 16:
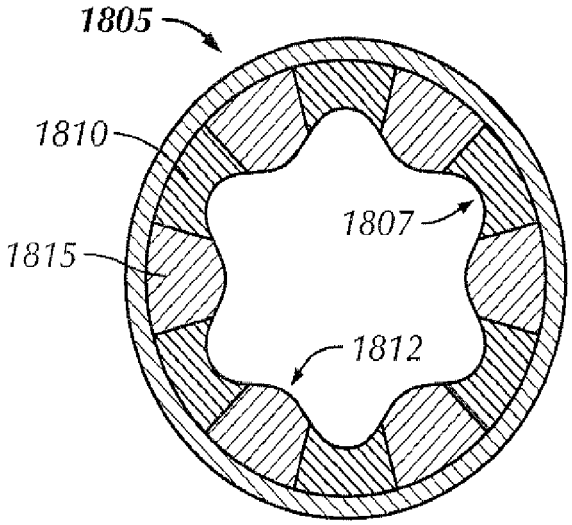

The benefits from use of constraining devices may also provide for alternative stator designs. For example, as illustrated in FIG. 16, a stator may be formed using a hybrid or tailored material profile. As illustrated in FIG. 16, the peaks and valleys of the stator 1805 may be formed from different materials, where the valleys 1807 are formed from a resilient elastomeric material 1810, and the peaks 1812 are formed from a rigid material, such as a hard plastic, hard rubber, metal, ceramic, or composite material. The forces encountered during rotor nutation differ for the peaks and valleys, where the valleys encounter compressive forces and the peaks endure sliding forces. The hybrid construction may result in contact of the rotor, which may be a metal, with the rigid material of the stator peaks, which may also be a metal, but allows for flow of solids, such a drilling mud including solid materials, through the motor without issue.

One potential benefit of a constrained motor may be a reduction in vibrations associated with the mud motor. Constrained lateral forces may result in less wobble or a narrower orbital path as compared to an un-constrained motor. As a result of reduced vibrations, drilling may be improved, such as by resulting in, one or more of a better hole quality, an even-gage hole, and improved steering.

A reduction in the axial length of the motor may also provide the ability to modify the drill string components to incorporate a motor. For example, an adjustable bend housing typically includes a transmission shaft to transmit torque generated from the power section of the drilling motor to a bearing section of the drilling motor. Due to the potential reduction in size of the motor due to the constraining devices disclosed herein, it may be possible to incorporate a motor into the bent housing along with the transmission shaft. Similarly, motors according to embodiments herein may advantageously be incorporated into a stabilizer, a steering head, or other various portions of the bottom hole assembly (BHA).

The decreased axial length may also facilitate disposal of wire through the motor and provide space for additional downhole instrumentation, such as instrumentation to monitor the motor and/or components below the motor. Instrumentation may beneficially monitor motor RPM, pressure drop, and other factors, possibly avoiding stalls and allowing operation of the motor at high efficiency or peak efficiency, each of which may result in improved drilling performance (increased rate of penetration, less downtime due to stalled motors, etc.).

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A mud motor assembly, comprising:

a top sub comprising a shoulder having a first inner diameter proximate a distal end of the top sub;

a power section comprising a progressive cavity motor comprising a stator and a rotor configured to rotate eccentrically when a drilling fluid is passed through the motor, the stator and rotor each having a proximal end and a distal end, wherein a proximal end of the power section is coupled to the distal end of the top sub;

a rotor catch comprising a shaft having a proximal end and a distal end, and rotating eccentrically via transmission of the eccentric rotor motion;

wherein the distal end of the shaft is coupled directly or indirectly to a proximal end of the rotor;

wherein the shaft extends from the distal end of the rotor catch into the top sub a distance past the shoulder, wherein at least the portion of the shaft extending past the shoulder has an outer diameter less than the first inner diameter of the shoulder;

wherein the proximal end of the shaft has an effective outer diameter greater than the first inner diameter and/or is coupled to a rotor catch assembly comprising one or more components having an effective outer diameter greater than the first inner diameter;

at least one apparatus disposed intermediate the proximal and distal end of the rotor catch shaft, the at least one apparatus configured to constrain the radial and/or tangential movement of the rotor catch shaft and by transmission via the shaft to constrain the radial and/or tangential movement of the rotor.

2. The assembly of claim 1, wherein the at least one apparatus is disposed intermediate the shoulder and the distal end of the shaft.

3. The assembly of claim 1, wherein the at least one apparatus is operative with at least one of an inner surface of the top sub and an inner surface of the power section.

4. The assembly of claim 1, wherein an operative area of the at least one apparatus is concentric with an operative area of the rotor/stator pair.

5. The assembly of claim 1, wherein the at least one apparatus limits the movement of a geometric center of the rotor to a predetermined path.

6. The assembly of claim 1, wherein a surface of the stator is made of a flexible material to permit a seal to form between contacting surfaces of the rotor and the stator, and wherein the at least one apparatus limits the deflection or compression of the flexible material to less than 0.64 mm.

7. The mud motor assembly of claim 1, wherein the stator has a contact surface formed from a rigid material, the rigid material including at least one of a metal, a composite, a ceramic, a hard plastic, or PCD.

8. The assembly of claim 7, wherein the stator has a profile including peak sections and valley sections, and wherein the peak sections comprise the rigid material and the valley sections comprise a resilient material.

9. The assembly of claim 7, wherein the rotor comprises a contact surface formed from a rigid material, which may be the same or different than the rigid material of the stator.

10. The assembly of claim 9, wherein the rotor comprises a layer comprising a resilient material and a contact surface layer comprising the rigid material.

11. The assembly of claim 9, wherein the contact surface of at least one of the rigid materials of the stator or the rotor are coated or treated to reduce at least one of friction and wear.

12. The assembly of claim 1, wherein the at least one apparatus comprises one or more of:

a. a bearing assembly for controlling or limiting the eccentric movement of the shaft and thereby controlling or limiting the movement of the rotor within the stator;

b. a wheel assembly for controlling or limiting the eccentric movement of the shaft and thereby controlling or limiting the movement of the rotor within the stator;

c. a fixed insert for controlling or limiting the eccentric movement of the shaft and thereby controlling or limiting the movement of the rotor within the stator;

d. a rotatable insert for controlling or limiting the eccentric movement of the shaft and thereby controlling or limiting the movement of the rotor within the stator; and e. a precession device for controlling or limiting the eccentric movement of the shaft and thereby controlling or limiting the movement of the rotor within the stator.

13. The assembly of claim 12, wherein the wheel assembly comprises a wheel mounted on a shaft of the rotor, the wheel being configured to run around an inner surface of the stator.

14. The assembly of claim 13, wherein the outside diameter of the wheel is equal to the diameter of the inner surface of the stator minus twice the predetermined maximum offset of the rotor from its geometric centerline.

15. The assembly of claim 12, wherein the wheel assembly comprises a wheel mounted on a shaft of the stator, the wheel being configured to permit the rotor to run around an outer surface of the stator.

16. The assembly of claim 15, wherein the outside diameter of the wheel is equal to that of the inner surface of the rotor minus twice the predetermined maximum offset of the rotor from its geometric centerline.

17. The assembly of claim 12, wherein the fixed insert is mounted within an outer member of the rotor-stator pair and has a central aperture through which a shaft of an inner member of the rotor-stator pair can pass, the diameter of the central aperture being sized to limit the radial motion of the rotor relative to the stator.

18. The assembly of claim 12, wherein the fixed insert has a further plurality of apertures to permit the flow of fluid therethrough.

19. The assembly of claim 12, wherein the rotatable insert is mounted within the stator and has an aperture through which a shaft of the rotor can pass, the aperture being offset from the center of the rotatable insert such that movement of the rotor is limited to a predetermined path.

20. The assembly of claim 19, wherein the rotatable insert comprises a further plurality of apertures to permit the flow of fluid therethrough.

21. The assembly of claim 12, where wherein the precession device comprises a lobed wheel mounted on the shaft of the rotor, the wheel being configured to run on a lobed track fixed to the stator.

22. The assembly of claim 21, wherein axial surfaces of the wheel and track are parallel to the axis of the motor.

23. The assembly of claim 21, wherein axial surfaces of the wheel and track are helical and are not parallel to the axis of the motor.

24. The assembly of claim 12, where wherein the precession device is configured to provide at least one of:

optimum sealing of the cavities within the motor or pump;

optimum stresses in the different materials comprising the rotor and stator; or a predetermined trajectory and rotation of the rotor.

25. A drilling assembly, comprising:

a mud motor assembly comprising a top sub and a power section;

the top sub comprising a shoulder having a first inner diameter proximate a distal end of the top sub;

the power section comprising a progressive cavity motor comprising a stator and a rotor configured to rotate eccentrically when a drilling fluid is passed through the motor, the stator and rotor each having a proximal end and a distal end, wherein the proximal end of the stator is coupled to the distal end of the top sub;

a rotor catch comprising a shaft having a proximal end and a distal end, and rotating eccentrically via transmission of the eccentric rotor motion;

wherein the distal end of the shaft is coupled directly or indirectly to a proximal end of the rotor;

wherein the shaft extends from the distal end of the rotor catch into the top sub a distance past the shoulder, wherein at least the portion of the shaft extending past the shoulder has an outer diameter less than the first inner diameter of the shoulder;

wherein the proximal end of the shaft has an effective outer diameter greater than the first inner diameter and/or is coupled to a rotor catch assembly comprising one or more components having an effective outer diameter greater than the first inner diameter;

at least one apparatus disposed intermediate the proximal and distal end of the rotor catch shaft, the at least one apparatus configured to constrain the radial and/or tangential movement of the rotor catch shaft and by transmission via the shaft to constrain the radial and/or tangential movement of the rotor;

a motor output shaft directly or indirectly coupled to the distal end of the rotor; and a drill bit directly or indirectly coupled to a distal end of the motor output shaft.

26. A method of drilling a wellbore through a subterranean formation, the method comprising:

passing a drilling fluid through a mud motor assembly, the mud motor assembly including:

a top sub comprising a shoulder having a first inner diameter proximate a distal end of the top sub;

a power section comprising a progressive cavity motor comprising a stator and a rotor configured to rotate eccentrically when a drilling fluid is passed through the motor, the stator and rotor each having a proximal end and a distal end, wherein a proximal end of the power section is coupled to the distal end of the top sub;

a rotor catch comprising a shaft having a proximal end and a distal end, and rotating eccentrically via transmission of the eccentric rotor motion;

wherein the distal end of the shaft is coupled directly or indirectly to a proximal end of the rotor;

wherein the shaft extends from the distal end of the rotor catch into the top sub a distance past the shoulder, wherein at least the portion of the shaft extending past the shoulder has an outer diameter less than the first inner diameter of the shoulder;

wherein the proximal end of the shaft has an effective outer diameter greater than the first inner diameter and/or is coupled to a rotor catch assembly comprising one or more components having an effective outer diameter greater than the first inner diameter; and at least one apparatus disposed intermediate the proximal and distal end of the rotor catch shaft, the at least one apparatus configured to constrain the radial and/or tangential movement of the rotor catch shaft and by transmission via the shaft to constrain the radial and/or tangential movement of the rotor, and drilling the formation using a drill bit directly or indirectly coupled to the rotor.

* * * * *